US006939107B2

(12) United States Patent
Mongillo, Jr. et al.

(10) Patent No.: US 6,939,107 B2
(45) Date of Patent: Sep. 6, 2005

(54) SPANWISELY VARIABLE DENSITY PEDESTAL ARRAY

(75) Inventors: Dominic J. Mongillo, Jr., West Hartford, CT (US); Young H. Chon, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/717,806

(22) Filed: Nov. 19, 2003

(65) Prior Publication Data

US 2005/0106007 A1 May 19, 2005

(51) Int. Cl.[7] ..... F01D 25/12
(52) U.S. Cl. ..... 416/96 R; 416/97 R; 415/115
(58) Field of Search ..... 416/96 R, 97 R; 415/115

(56) References Cited

U.S. PATENT DOCUMENTS 3,094,310 A * 6/1963 Bowmer ..... 416/92
4,278,400 A * 7/1981 Yamarik et al. ..... 416/97 R
4,775,296 A * 10/1988 Schwarzmann et al. .. 416/97 R

* cited by examiner

*Primary Examiner*—Ninh H. Nguyen
(74) *Attorney, Agent, or Firm*—Bachman & LaPointe, P.C.

(57) ABSTRACT

A turbine engine component, such as a blade or vane, has a system for cooling a trailing edge portion thereof. The system includes a plurality of rows of pedestals which vary in density along a span of the component. In a preferred embodiment of the present invention, the number of rows of pedestals increases as one moves along the span of the component from an inner diameter region to an outer diameter region.

15 Claims, 4 Drawing Sheets

SPANWISELY VARIABLE DENSITY PEDESTAL ARRAY

STATEMENT OF GOVERNMENT INTEREST

The Government of the United States of America may have rights in the present invention as a result of Contract No. N00019-02-C-3003 awarded by the Department of the Navy.

BACKGROUND OF THE INVENTION (1) Field of the Invention

The present invention relates to a component for use in a turbine engine, such as a vane or blade, having improved trailing edge cooling.

(2) Prior Art

Turbine engine components such as vanes and blades are subject to temperature extremes. Thus, it becomes necessary to cool various portions of the components. Typically, the trailing edge portions of such components are provided with cooling passages and a series of outlets along the trailing edge communication with the passages. Despite the existence of such structures, there remains a need for improved trailing edge cooling of such components.

SUMMARY OF THE INVENTION

Accordingly, it is an object of the present invention to provide a turbine engine component having a spanwisely variable density pedestal array for improving spanwise uniformity of the exhaustive coolant.

It is a further object of the present invention to provide a turbine engine component having a spanwisely variable density pedestal array which optimizes internal cooling fluid heat up.

The foregoing objects are attained by the turbine engine component of the present invention.

In accordance with the present invention, a turbine engine component has means for cooling a trailing edge portion, which means comprises a plurality of rows of pedestals which vary in density along a span of the component. In a preferred embodiment of the present invention, the number of rows of pedestals increases as one moves along the span of the component from an inner diameter region to an outer diameter region.

Other details of the spanwisely variable density pedestal arrays of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Incorporation of a spanwisely variable density pedestal array in a turbine engine component, such as a vane or a blade, enables the optimization of internal cooling fluid, typically air, heat up by balancing the heat up and pressure loss of the cooling fluid in both the radial and axial directions. The ability to optimize the internal convective efficiency, which is a measure of the potential a fluid has to extract heat from a known heat source, is critical in establishing the oxidation capability of a component for the minimum given available flow rate allotted.

Increasing the density of the pedestal array in the axial direction at the outer diameter (OD) inlet of the component, where the cooling fluid source is colder, allows more component cross sectional area to be consumed. This is beneficial since it enables an adequate level of through flow cavity Mach number to be achieved to meet oxidation life requirements adjacent to the trailing edge through the flow cavity.

Figure 1:
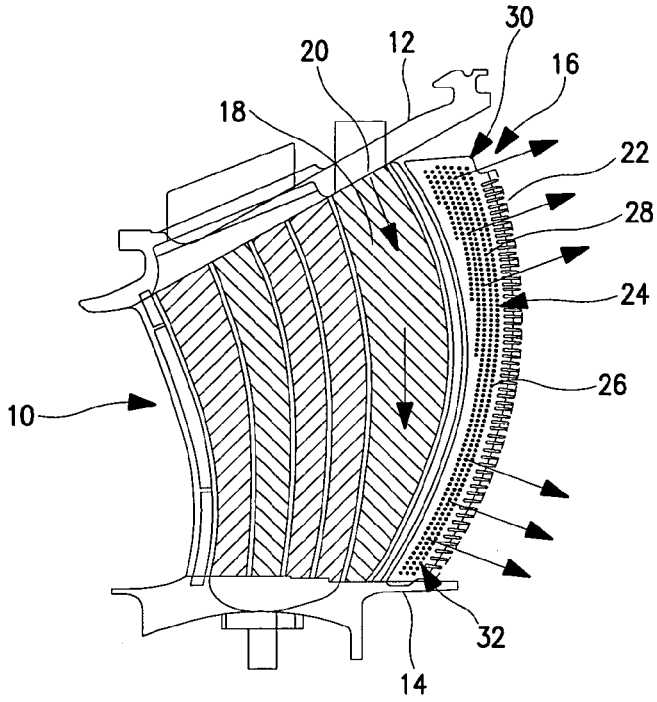
FIG. 1 is a schematic representation of a turbine vane having a spanwisely variable density pedestal array in accordance with the present invention.
Figure 2:
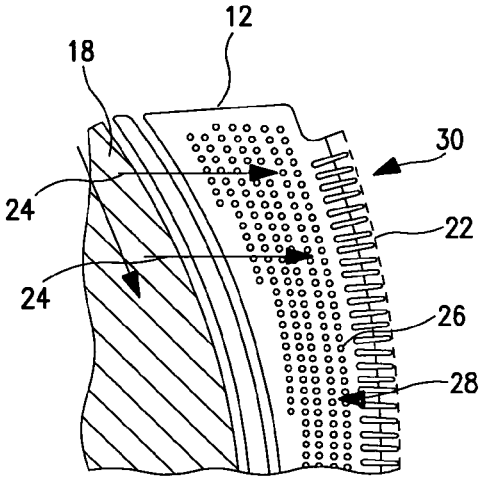
FIG. 2 is an enlarged view of the pedestal array at an outer diameter portion of the vane of FIG. 1.
Figure 3:
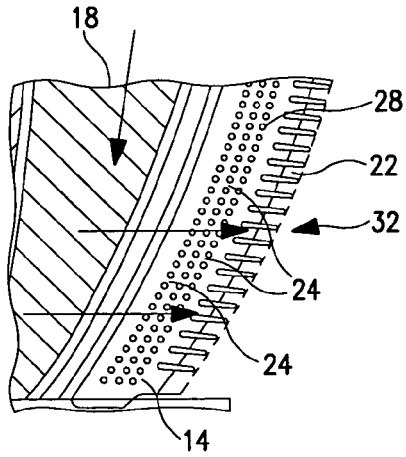
FIG. 3 is an enlarged view of the pedestal array at an inner diameter portion of the vane of FIG. 1.

Referring now to FIGS. 1–3, a turbine engine component 10, such as an airfoil portion of a vane or blade, is illustrated. The component 10 has an OD edge 12 and an inner diameter (ID) edge 14. To cool the trailing edge 16 of the component 10, a cooling passageway 18, through which a cooling fluid, such as engine bleed air flows, is incorporated into the component 10. The cooling passageway 18 has an inlet 20 at the OD edge 12 of the component 10. The cooling fluid in the cooling passageway 18 is exhausted at the trailing edge 16 of the component 10 through a plurality of trailing edge slots 22.

To improve cooling efficiency at the trailing edge a plurality of rows 24 of pedestals are provided. Each pedestal row 24 comprises a plurality of pedestals 26 of any desired shape or configuration. Adjacent ones of the pedestals 26 form a cooling channel 28 which receives cooling fluid from the cooling passageway 18 and which distributes the cooling fluid for exhaust through one or more of the slots 22.

As can be seen from FIGS. 1–3, the density of the pedestal rows 24 varies along the span of the turbine engine component 10. As can be seen from FIG. 1, the number of pedestal rows 24 increases as one moves along the span of the component 10 from the ID edge 14 to the OD edge 12. In particular, the density of the pedestal rows 24 is greater in the OD region 30 of the component 10 than the ID region 32. In a preferred embodiment, there are at least twice as many pedestal rows 24 in the OD region 30 than in the ID region 32. In a most preferred embodiment, there are seven pedestal rows 24 in the OD region 30 and three pedestal rows 24 in the ID region 32.

Figure 4:
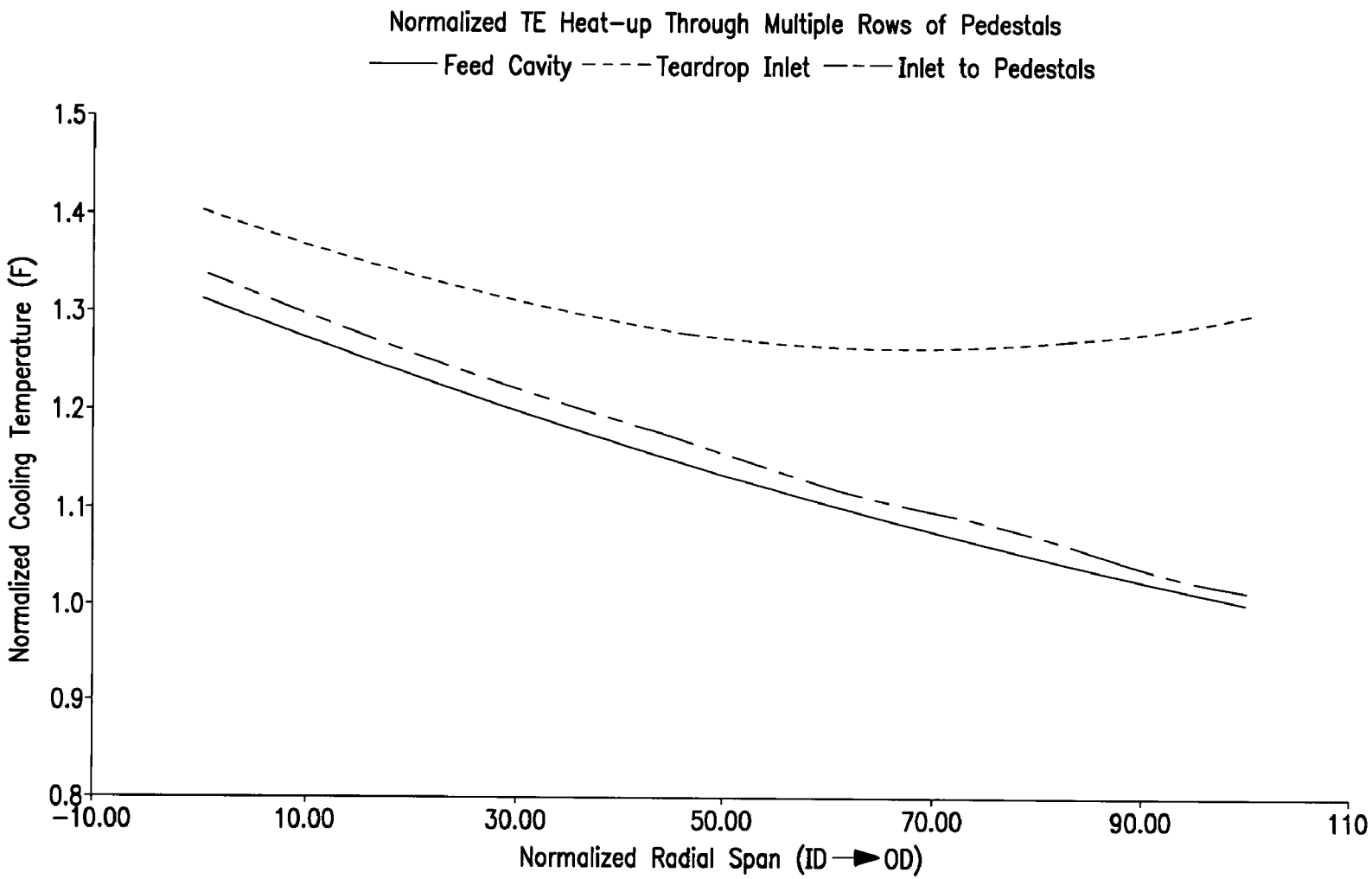
FIG. 4 is a graph illustrating the trailing edge heat-up through multiple rows of pedestals in accordance with the present invention.

The increased pressure loss associated with the higher axial pedestal row density at the OD region 30 of the component 10 minimizes the total coolant flow exhausted into the main stream through trailing edge slot tear drop region 40. Due to the increased number of pedestal rows 24 in the OD region 30, the convective efficiency is optimized as the cooler coolant fluid, typically coolant air, is heated significantly more as it migrates axially through the increased density pedestal array of the present invention. This is reflected by the graph shown in FIG. 4. Since the coolant mass flow at the OD edge 12 incurs more heat extraction, a higher net heat flux results for a constant radial coolant mass flow rate.

Figure 5:
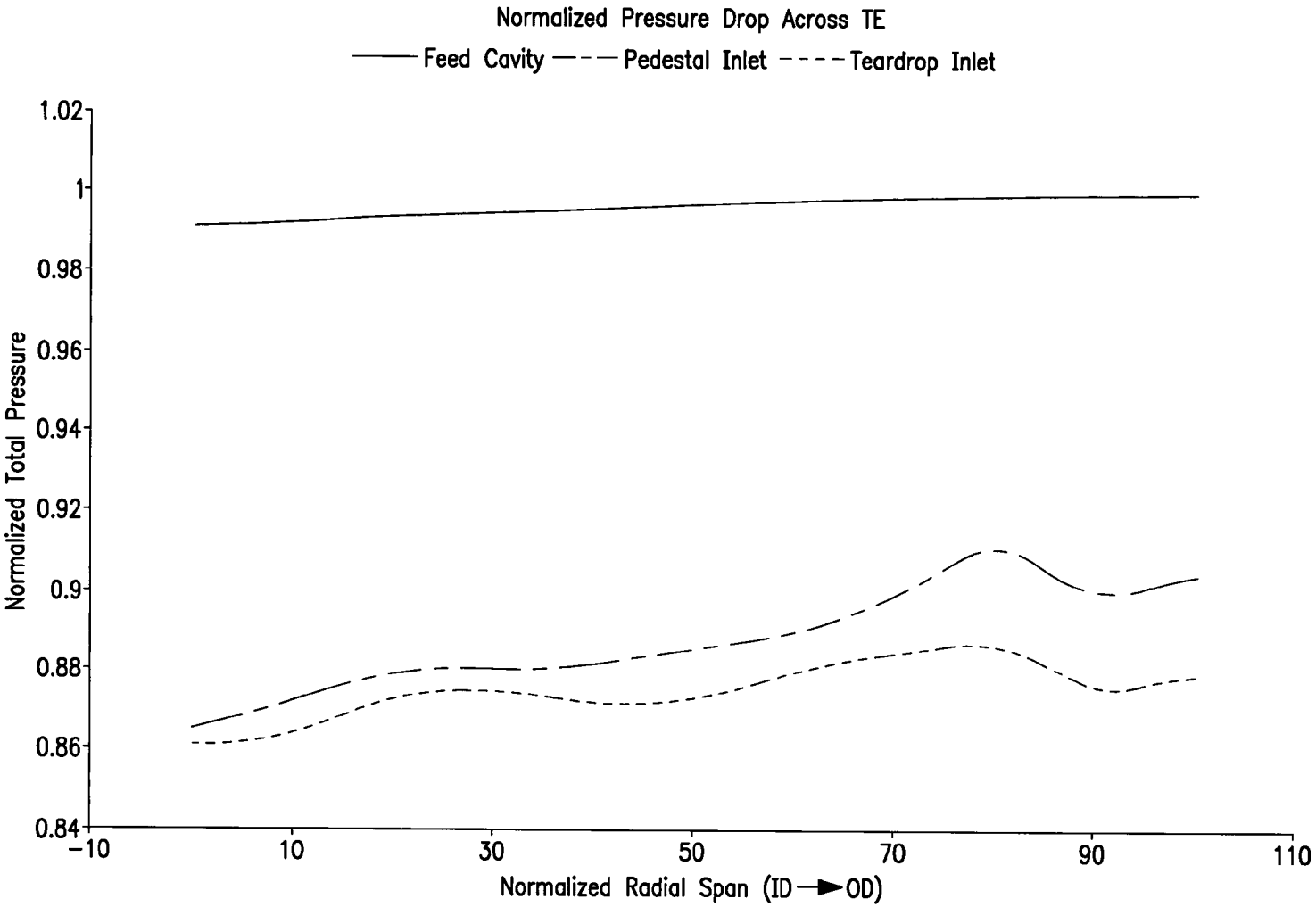
FIG. 5 is a graph illustrating the pressure drop across the trailing edge of the vane using the pedestal array of the present invention.

The reduced pressure loss associated with the lower axial pedestal row density in the ID portion 32 of the component 10 is beneficial from two perspectives. The absolute driving pressure level at the ID portion 32 of the component 10 is reduced, minimizing the axial pressure loss through the lower density ID pedestal array. This enables the optimum local trailing edge slot coolant flow rate to be achieved. This is reflected by the graph shown in FIG. 5. The lower density of axial pedestals also reduces the total coolant air heat up as it migrates axially through the reduced density pedestal array and is reflected by the graph of FIG. 4. As a result of the increased heat up, the coolant flow as it progresses along a radial path from the OD region 30 to the ID region 32 of the component trailing edge passage is able to be mitigated as flow migrates in the axial direction through the reduced density pedestal array at the ID region 32 of the component 10.

Figure 6:
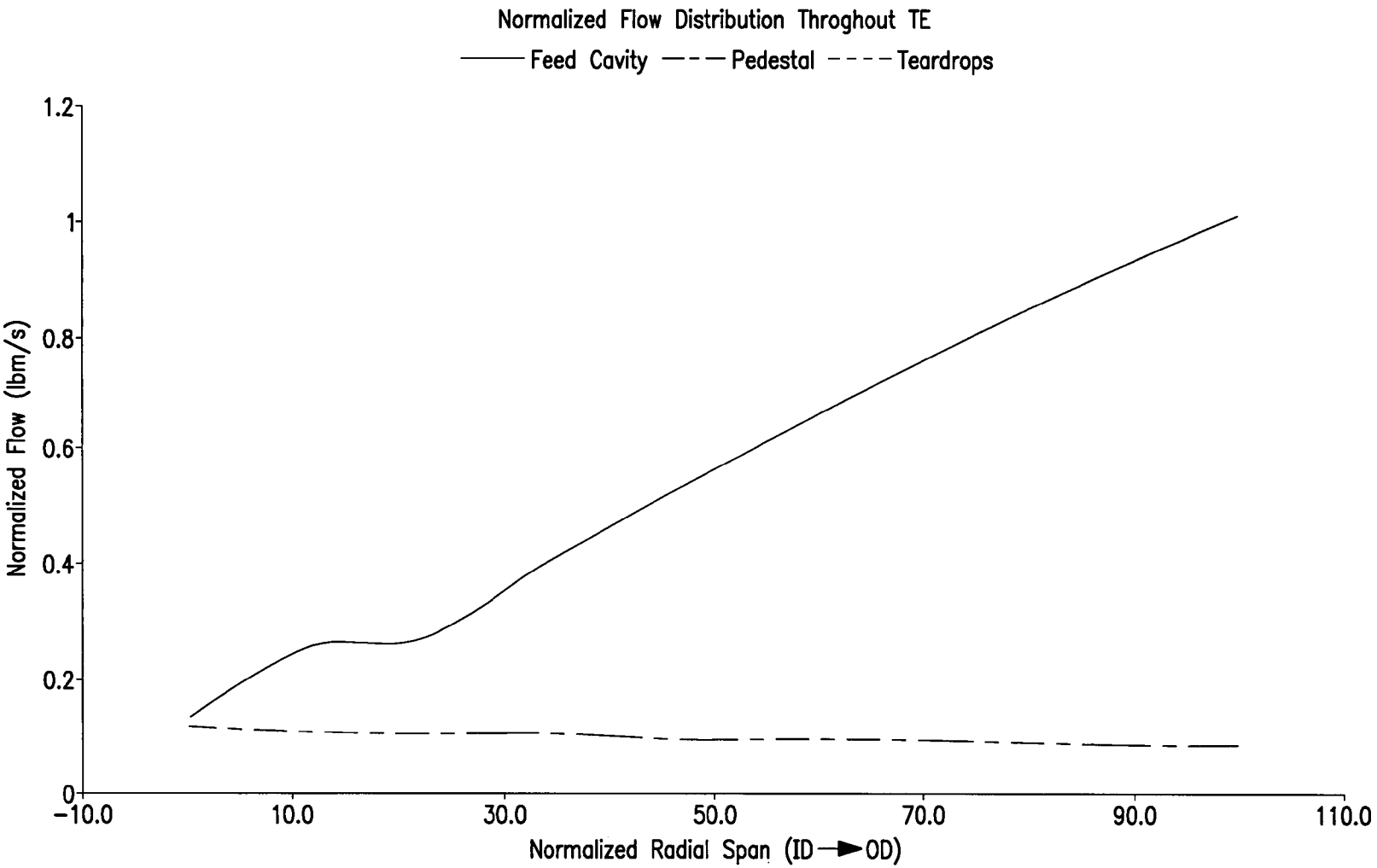
FIG. 6 is a graph showing the flow distribution through the trailing edge of a vane using the pedestal array of the present invention.

A spanwise variable density pedestal array in accordance with the present invention ensures slot flow rate uniformity of the exhaustive coolant, as shown in the graph of FIG. 6, by offsetting frictional loss and temperature rise incurred by the working fluid.

By minimizing the total heat up incurred, a more uniformly distributed coolant temperature is achievable as the coolant is ejected from ID to OD trailing edge slots. As a result, a more uniformly distributed cooling effectiveness is achievable that will result in a more uniform radial distress pattern along the component trailing edge surface.

Incorporating the spanwisely variable density pedestal array into turbine engine components, such as vanes and blades, uniformly optimizes trailing edge slot coolant Mach number and velocity with coolant air temperature rise and local thermal convective efficiency and performance by offsetting the radial pressure loss due to friction with the axial pressure loss through a variable density pedestal array. By maintaining uniformity of the trailing edge slot exit velocity, the mixing loss between the high velocity mainstream gas flow and the slot coolant exit flow can be minimized.

It is apparent that there has been provided in accordance with the present invention a spanwisely variable density pedestal array which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations will fall within the broad scope of the appended claims.

What is claimed is:

1. A turbine engine component having a trailing edge portion, said component comprising:

means for cooling the trailing edge portion; and said cooling means comprising a cooling fluid flowing in a passageway in a first direction and a plurality of rows of pedestals which receives said cooling fluid from said passageway and which varies in density along a span of the component with the number of said rows of pedestals decreasing in the flow direction of said cooling fluid.

2. A turbine engine component according to claim 1, wherein the number of rows of pedestals increases as one moves along the span of the component from an inner diameter region to an outer diameter region.

3. A turbine engine component according to claim 1, wherein the number of rows of pedestals in an outer diameter region of said component is greater than the number of rows of pedestals in an inner diameter region of said component.

4. A turbine engine component according to claim 3, wherein the number of pedestal rows in the outer diameter region is at least twice as many as the number of pedestal rows in the inner diameter region.

5. A turbine engine component according to claim 3, wherein there are seven pedestal rows in the outer diameter region and three pedestal rows in the inner diameter region.

6. A turbine engine component according to claim 1, wherein said component comprises a vane and said cooling means is located in an airfoil portion of said vane.

7. A turbine engine component according to claim 1, wherein said component comprises a blade and said cooling means is located in an airfoil portion of said blade.

8. A turbine engine component according to claim 1, wherein said passageway has an inlet at an outer edge portion of said component.

9. A turbine engine component having a trailing edge portion, said component comprising:

means for cooling the trailing edge portion;

said cooling means comprising a plurality of rows of pedestals which varies in density along a span of the component; and said cooling means further comprising a cooling passage having an inlet at the outer diameter of the component, which cooling passage provides a cooling fluid to said pedestal rows, and a plurality of slots along a trailing edge of said component through which said cooling fluid is exhausted, which slots are in fluid communication with a region containing said pedestal rows.

10. A turbine engine component according to claim 6, wherein said variable density pedestal rows optimizes trailing edge slot coolant Mach number and velocity with coolant air temperature rise and local thermal convective efficiency and performance.

11. A turbine engine component comprising:

an airfoil portion having an outer edge portion and an inner edge portion;

a cooling passageway located in said airfoil portion for providing a cooling fluid to a trailing edge portion of said airfoil portion;

a plurality of cooling slots in said trailing edge portion for exhausting said cooling fluid; and means for uniformly optimizing trailing edge slot coolant Mach number and velocity with coolant air temperature rise and local thermal convective efficiency and performance so that a substantially uniformly distributed coolant temperature is achieved as said cooling fluid is exhausted from said cooling slots from said inner edge portion to said outer edge portion.

12. A turbine engine component according to claim 11, wherein said uniformly optimizing means comprises a plurality of rows of pedestals having a spanwise variable density.

13. A turbine engine component according to claim 12, wherein the number of rows of said pedestals adjacent said inner edge is less than the number of rows of said pedestals adjacent said outer edge.

14. A turbine engine component according to claim 11, wherein a flow rate of said cooling fluid is least at said inner edge portion and greatest at said outer edge portion.

15. A turbine engine component according to claim 14, wherein said cooling passageway has an inlet at said outer edge portion.

* * * * *